US008652302B2

(12) United States Patent
Boeck et al.

(10) Patent No.: US 8,652,302 B2
(45) **Date of Patent: *Feb. 18, 2014**

(54) FABRIC BELT FOR A MACHINE FOR THE PRODUCTION OF WEB MATERIAL, PARTICULARLY PAPER OR CARDBOARD

(75) Inventors: Johann Boeck, Fornach (AT); Matthias Hoehsl, Heidenheim (DE); Petra Hack-Ueberall, Reutlingen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/408,539

(22) Filed: Feb. 29, 2012

(65) Prior Publication Data

US 2012/0160439 A1 Jun. 28, 2012

Related U.S. Application Data

(63) Continuation of application No. 12/479,346, filed on Jun. 5, 2009, now Pat. No. 8,252,146, which is a continuation of application No. PCT/EP2007/063471, filed on Dec. 6, 2007.

(30) Foreign Application Priority Data

Dec. 8, 2006 (DE) ..... 10 2006 059 482
Dec. 3, 2007 (DE) ..... 10 2007 058 369

(51) Int. Cl.
*D21F 1/10* (2006.01)
*D03D 11/00* (2006.01)

(52) U.S. Cl.
USPC ..... 162/348; 162/903; 139/383 A

(58) Field of Classification Search
CPC ..... D21F 1/0036
USPC ..... 162/348, 358.2, 900, 902, 903, 904, 162/116; 139/383 A, 383 AA, 425 A, 383 R
See application file for complete search history.

(56) References Cited

U.S. PATENT DOCUMENTS

| | | | |
|---|---|---|---|
| 5,544,678 | A | 8/1996 | Barrett |
| 6,202,705 | B1 | 3/2001 | Johnson et al. |

(Continued)

FOREIGN PATENT DOCUMENTS

| | | | |
|---|---|---|---|
| EP | 0432413 | A1 | 6/1991 |
| EP | 1605095 | A1 | 12/2005 |
| JP | 4-185788 | A | 7/1992 |
| WO | 2004085740 | A2 | 7/2004 |
| WO | 2005001197 | A1 | 1/2005 |

(Continued)

OTHER PUBLICATIONS

International Preliminary Report, International Search Report & Written Opinion for PCT/EP2007/063471.

(Continued)

*Primary Examiner* — Eric Hug
(74) *Attorney, Agent, or Firm* — Taylor IP, P.C.

(57) ABSTRACT

A fabric belt for a machine for producing a web of fibrous material includes: a first fabric layer including a web contact side and formed by interweaving a plurality of warps with a plurality of wefts; and a second fabric layer positioned below said first fabric layer and formed by interweaving a plurality of warps with a plurality of wefts, a first ratio of a number of said plurality of warps of said first fabric layer to a number of said plurality of warps of said second fabric layer being greater than 1, a second ratio of a number of said plurality of wefts of said first fabric layer to a number of said plurality of wefts of said second fabric layer being greater than 1.

34 Claims, 8 Drawing Sheets

(56) References Cited

U.S. PATENT DOCUMENTS

| | | | | |
|---|---|---|---|---|
| 6,354,335 | B1 | 3/2002 | Taipale et al. | |
| 7,059,357 | B2 | 6/2006 | Ward | |
| 7,306,014 | B2 | 12/2007 | Nagura et al. | |
| 7,384,513 | B2 | 6/2008 | Eagles | |
| 8,252,146 | B2 * | 8/2012 | Boeck et al. | 162/348 |
| 2004/0182465 | A1 * | 9/2004 | Ward | 139/383 A |
| 2006/0096653 | A1 | 5/2006 | Eagles | |
| 2008/0149213 | A1 * | 6/2008 | Quigley | 139/408 |

FOREIGN PATENT DOCUMENTS

| | | | |
|---|---|---|---|
| WO | 2005014926 | A1 | 2/2005 |
| WO | 2006020414 | A1 | 2/2006 |

OTHER PUBLICATIONS

Communication from European Patent Office dated Mar. 15, 2013 for European Patent Application No. 07 847 940.9-1710 (3 pages).

* cited by examiner

FABRIC BELT FOR A MACHINE FOR THE PRODUCTION OF WEB MATERIAL, PARTICULARLY PAPER OR CARDBOARD

CROSS REFERENCE TO RELATED APPLICATIONS

This is a continuation of U.S. patent application Ser. No. 12/479,346, entitled "FABRIC BELT FOR A MACHINE FOR THE PRODUCTION OF WEB MATERIAL, PARTICULARLY PAPER OR CARDBOARD", filed Jun. 5, 2009, which is incorporated herein by reference. U.S. patent application Ser. No. 12/479,346 is a continuation of PCT application No. PCT/EP2007/063471, entitled "CLOTH TAPE FOR A MACHINE FOR THE PRODUCTION OF SHEET MATERIAL, IN PARTICULAR PAPER OR CARDBOARD", filed Dec. 6, 2007, which is incorporated herein by reference.

BACKGROUND OF THE INVENTION

1. Field of the Invention

The present invention relates to a fabric belt for a machine for the production of web material, particularly paper or cardboard. Such a fabric belt may be utilized, for example, in a forming section as a forming screen.

2. Description of the Related Art

In the production of web material, such as paper, it is generally required that a very fine structuring is present at the web material contact side, that is to say the side the web material to be produced is in direct contact with, in order to avoid any marking effects. An abrasion or wear volume that is as large as possible should be present on the running side, that is to say on the side that is in contact with various rollers deflecting and advancing the web material, or a very robust construction should be created in order to keep wear and tear at a minimum.

A composite fabric for machine screens is known from EP 0 432 413 A1, wherein two fabric layers on top of each other, having two layers of transverse threads arranged directly on top of each other, are provided. The number of transverse threads of the layer on the paper side corresponds to the number of transverse threads of the layer on the machine or running side. Threads extending in longitudinal direction of the fabric are incorporated into both fabric layers, and alternate on the crossing points between both fabric layers in order to create a structural connection between the same.

WO 2006/020414 A1 discloses a fabric for a paper machine, having two fabric layers positioned on top of each other, including warps and wefts. For this purpose the number of wefts in the fabric layer on the paper side is twice as high as the number of warps in the fabric layer on the running or machine side.

WO 2004/085740 A2 discloses a fabric belt for a paper machine, wherein the connection between two fabric layers is carried out by way of said warps that are structurally incorporated and alternating at crossing points between the fabric layers. The fabric layers further include respective layers of wefts, wherein the number of wefts in the fabric layer on the paper side is in turn twice as large as the number of wefts in the fabric layer on the running side.

A fabric belt for a paper machine is known from EP 1 605 095 A1, wherein both fabric layers are embodied with threads extending in a longitudinal belt direction, wherein the number of said threads in the fabric layer on the running side is twice as large as that in the fabric layer on the paper side. The connection of both fabric layers is carried out by way of said structurally binding threads extending in the longitudinal direction and transverse threads alternating between the fabric layers.

What is needed in the art is a fabric belt for a machine for the production of web material, having a high degree of wear resistance and very low marking properties.

SUMMARY OF THE INVENTION

The present invention provides a fabric belt for a machine for the production of web material, particularly paper or cardboard, including a first fabric layer providing a web material contact side, having warps and wefts, and a second fabric layer positioned below the first fabric layer, having warps and wefts, wherein the ratio of the number of warps of the first fabric layer to the number of warps of the second fabric layer is greater than 1.

Due to the fact that a warp ratio is therefore selected, which is greater than 1, a great warp density is present on the web material contact side of the fabric belt, resulting in the fact that a denser fabric structure having a greater number of offset points of the wefts per unit of area is present. The tendency for markings can therefore be significantly reduced. The warp density is lower at the second fabric layer positioned below such that particularly when said second fabric layer provides the machine contact side, the requirements at that location are met by way of a respective thread selection.

In a particularly advantageous embodiment variation the warp ratio is not a whole number. Furthermore, a warp ratio of not greater than 1.5 has proven very advantageous.

According to a further preferred embodiment of the invention it is provided that the ratio of the number of wefts of the first fabric layer to the number of wefts of the second fabric layer is greater than 1, particularly 1.5, or 2.

In order to avoid hydraulic markings in the paper web that are caused by locally strongly differing dewatering performances, a preferred embodiment of the invention provides that the warps of the first fabric layer relative to the warps of the second fabric layer, as viewed in the direction of the course of the wefts, are arranged at an offset. Due to said arrangement the dewatering performance becomes more uniform across the width of the fabric belt.

Preferably the first fabric layer and the second fabric layer are connected to each other via binder threads, wherein particularly the binding threads are arranged in pairs, the binding threads of a pair alternate during the interweaving of threads of the first and the second fabric layer, and the binding threads of a pair cross each other during the alternating of interweaving using threads of the first fabric layer to the interweaving using threads of the second fabric layer, and vice versa, while forming crossing points.

This means that while one binder thread of the binder thread pair interweaves with threads of the first fabric layer, the other binder thread of the pair interweaves at least with one thread of the second fabric layer, and while one binder thread of the binder thread pair interweaves with at least one thread of the second fabric layer, the other binder thread of the pair interweaves with threads of the first fabric layer, wherein the binder threads of the pair cross during the alternating of interweaving using threads of the first fabric layer to the interweaving using threads of the second fabric layer, and said crossing points are preferably arranged between the first and the second fabric layers. For this purpose the binder threads of a pair usually alternate during the interweaving using the threads of the first fabric layer such that the same mutually weave a common weaving path in the first fabric layer.

A concrete embodiment of the invention provides that the weaving pattern of the fabric belt is continued in total pattern repeats, wherein the binder threads of each binder thread pair embody two crossing points within the total pattern repeat.

In order to reduce the tendency to markings, an advantageous further improvement of the invention provides that not all crossing points within the pattern repeat can be arranged on a parallel band of straight lines.

According to a further advantageous embodiment of the invention it is provided that at least part of the wefts of the fabric belt are binder wefts, which create a connection between the first fabric layer and the second fabric layer.

In the following a first warp shall mean a warp that is incorporated only into the first fabric layer. A first weft shall mean a weft that is incorporated only into the first fabric layer. Further, a second warp shall mean a warp that is incorporated only into the second fabric layer, as a second weft shall mean a weft that is incorporated only into the second fabric layer.

Preferably the binder wefts form a structure and are integral part of the first fabric layer. This means that part of the wefts of the first fabric layer are first wefts, another part of the wefts of the first fabric layer is the binder wefts, and all warps of the first fabric layer are first warps. It further means that the first fabric layer is formed by interweaving the first warps with the first wefts and with the binder wefts, wherein the first fabric layer is connected to the second fabric layer in that the binder wefts are interwoven with the first warps and with the second warps.

Furthermore, the weaving pattern formed by way of interweaving the first warps with the first wefts is continued by the alternating interweaving of the binder wefts with the first warps.

In order to provide a web material contact side, or paper side, having a great fiber support and low tendency to markings, it is of advantage, if the first fabric layer forms a plain weave.

Preferably all wefts of the second fabric layer are second wefts, e.g. wefts that are incorporated only into the second fabric layer, and all warps of the second fabric layer are second warps that are incorporated only into the second fabric layer. In this case the second fabric layer is formed by way of interweaving the second warps with the second wefts, and the first fabric layer is thereby connected to the second fabric layer, in that the binder wefts are interwoven with the first and with the second warps. In this embodiment the weaving pattern is not continued by the alternating interweaving of the binder wefts with the second warps by way of the interweaving of the second warps with the second wefts, e.g. the binder wefts are not integral part of the second fabric layer.

Particularly in this case each binder thread of a pair weaving each second warp crosses a second warp or two successive second warps between two successive crossing points on the outside of the second fabric layer. If the binder weft crosses two second warps, the force for binding the first fabric layer to the second fabric layer is distributed to two second warps per binder thread. In this manner the binding second warp is less drawn toward the first fabric layer.

In this regard the outside of the second fabric layer should be understood as the side of the second fabric layer, which is exposed, e.g. the side of the second fabric layer providing the running side of the machine contact side of the fabric belt.

A concrete embodiment of the invention provides that the weaving pattern of the second fabric layer includes four or eight second warps.

In the first case mentioned the weaving pattern of the second fabric layers preferably repeats in pattern repeats that are each formed by four second wefts and four second warps, wherein each second weft crosses three successive second warps running on the outside of the second fabric layer, before the same crosses a second warp running between the first and the second fabric layer.

In the latter case mentioned the weaving pattern of the second fabric layer repeats in pattern repeats that are each formed by eight second wefts and eight second warps, wherein each second weft crosses seven successive second warps running on the outside of the second fabric layer, before the same crosses a second warp running between the first and the second fabric layer.

A further concrete embodiment of the invention provides that the binder weft of a pair weaving first warps crosses at least two first warps running between two successive crossing points on the outside of the first fabric layer. In this regard it is also conceivable that the first of the two binder wefts of a pair crosses the same number of first warps running on the outside of the first fabric layer as the second binder weft of the pair, if the same weaves the first fabric layer.

In this regard the outside of the first fabric layer shall mean the side of the first fabric layer that is exposed, e.g. the side of the first fabric layer providing the paper side or the web material contact side of the fabric belt.

However, it is also conceivable that the first of both binder wefts of a pair crosses a different number of first warps running between successive crossing points on the outside of the first fabric layer, than the second binder weft of the pair, if the same weaves the first fabric layer.

In order to obtain a particularly plane and uniform paper side it is purposeful if the binder weft of a pair weaving the first warps crosses an uneven number of first warps running between two successive crossing points on the outside of the first fabric layer, and the center first warp of said uneven number of first warps forms a crossing point together with a directly adjacent pair of binder wefts.

Depending on the concrete requirements of the fabric belt according to the invention it may be purposeful if one or two first wefts and/or one or two second wefts are arranged between adjacent pairs of binder wefts.

In an alternative embodiment it may be provided that the ratio of the number of warps of the first fabric layer to the number of warps of the second fabric layer is particularly greater than or equal to 1.5, and that the cross-sectional area of the second wefts, e.g. the wefts that are interwoven with the warps of the second fabric layer, are within the range 0.018 mm2 to 0.284 mm2, preferably 0.023 mm2 to 0.197 mm2, most preferred greater than 0.1256 mm2. At such a large warp ratio it is also possible to utilize comparably thick second wefts. The wear resistance of the fabric belt according to the invention is significantly improved when utilizing said thick second wefts.

A further concrete embodiment of the invention provides that the ratio of the number of warps of the first fabric layer to the number of warps of the second fabric layer is particularly greater than or equal to 1.5, and that the cross-sectional area of the first warps is less than or equal to 0.018 mm2, preferably less than or equal to 0.011 mm2, most preferred less than or equal to 0.008 mm2. In this manner a particularly fine first fabric layer can be provided on the paper side that is free of markings.

The first warps may have a smaller cross-sectional dimension than the second warps. It is also conceivable that the first wefts have a smaller cross-sectional dimension than the second wefts for providing a uniform paper side. It is purposeful, particularly in connection with a plain weave of the first fabric layer, if the first wefts have a substantially equal cross-sectional dimension as the first warps.

It is further conceivable that the second wefts have a larger cross-sectional dimension than the second warps.

According to a concrete embodiment of the invention it may be provided that the density of the first warps in the first fabric layer is 25 per cm or higher, preferably 30 per cm or higher, particularly preferred 40 per cm or higher, and/or that the density of the first wefts in the first fabric layer is 25 per cm or higher, preferably 30 per cm or higher, particularly preferred 40 per cm or higher.

According to a further embodiment of the invention a warp-bound system may be provided instead of a weft-bound system. In this case at least part of the warps are binder warps, which create a connection between the first fabric layer and the second fabric layer.

In this case part of the warps of the first fabric layer may be first warps, another part of the warps of the first fabric layer may be the binder warps, and all wefts of the first fabric layer may be first wefts, wherein the first fabric layer is formed by the interweaving of the first wefts with the first warps and with the binder warps, and the first fabric layer is connected to the second fabric layer in that the binder warps are interwoven with the first and with the second wefts.

If the system is a structure-bound system, the weaving pattern formed by way of interweaving the first warps with the first wefts is continued by the alternating interweaving of the binder warps with the first wefts.

In this case the first fabric layer also preferably forms a plain weave.

If the binder threads are not an integral part of the second fabric layers, all warps of the second fabric layer are second warps, and all wefts of the second fabric layer are second wefts, wherein the second fabric layer is formed by the interweaving of the second wefts with the second warps, and the first fabric layer is connected to the second fabric layer in that the binder warps are interwoven with the first and with the second wefts.

In a further embodiment variation a third fabric layer may be provided, which provides a machine contact point. It may also be provided that the number of warps of the first fabric layer is greater than the number of warps of the third fabric layer.

The warps may be oriented such that the same extend in a longitudinal belt direction, wherein the wefts then extend in a transverse belt direction and create a connection between the first fabric layer and the second fabric layer.

The fabric belt according to the invention is preferably utilized as a forming fabric in a former of a paper machine, which produces printable papers, particularly supercalendared (SC), lightweight coated (LWC), or newsprint. For this purpose the forming fabric is preferably utilized in a lower screen position of the former, particularly the gap former or long screen former, or hybrid former.

Due to the high degree of abrasion resistance of the forming fabric according to the invention it may advantageously be utilized in paper machines operating at a machine speed of 1800 m/min or greater, particularly of 2000 m/min or greater.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
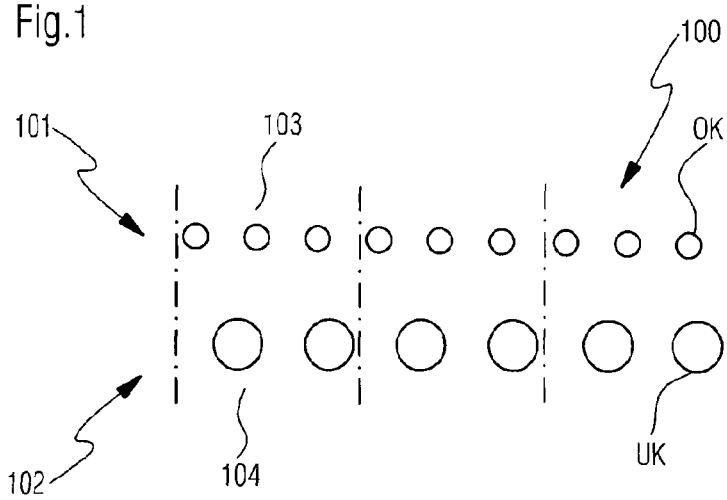
FIG. 1 is in a principal illustration a fabric belt having a warp ratio of 3:2.

Referring now to the drawings, and more particularly to FIG. 1, there is shown in a principal illustration a cutout of a fabric belt generally denoted with 100 for the production of web material, such as paper or the like, wherein said fabric belt 100 may be advantageously utilized, for example, as a forming fabric.

The fabric belt 100 includes two fabric layers 101, 102, wherein the first fabric layer 101 provides a web material contact side 103 on the upper side in FIG. 1, which is the outside of the first fabric layer 101. The web material to be produced, such as paper, forms a direct contact with said web material contact side 103. The lower or second fabric layer 102 provides a machine contact side 104. The fabric layer 100 comes into contact with said machine contact side 104 at the various rollers of a machine that guide, drive, and deflect the same, for the production of web material.

It is obvious in FIG. 1 that the first fabric layer 101, which provides the web material contact side 103, is constructed of warps OK, while the second fabric layer 102 is likewise constructed of warps UK. In the example shown in FIG. 1 a warp ratio of 3:2 is present between the warps OK of the first fabric layer 101 and the warps UK of the second fabric layer 102. This means that in the fabric belt 100, for example, based on a binding pattern, or also based on the total fabric belt, the number of warps OK of the first fabric layer 101 is greater by the factor 1.5 than the number of warps UK of the second fabric layer 102. Said warp ratio, which is greater than 1, but not greater than 1.5, and is not a whole number, has various advantages. First of all it becomes possible, as seen in FIG. 1, to utilize thinner warps OK for the first fabric layer 101 than the warps UK of the second fabric layer 102. This in turn leads to a finer fabric structure on the web material contact side 103 resulting in the reduction of the tendency for markings. On the machine contact side 104 the thicker warps UK may be oriented on the greater wear requirements at that location with regard to the dimensioning and also with regard to the material selection of the same, thus contributing to an optimum wear volume.

Both of these fabric layers 101, 102 seen in FIG. 1, or the warps OK, UK of the same may be interwoven with wefts, which are incorporated into the respective fabric layers, particularly into the fabric layer 101, in a structure forming manner, such as in order to create a plain weave at that location, but which also alternate between the fabric layers 101, 102, and realize a firm connection of both fabric layers in this manner. For this purpose FIG. 3 shows the course of the wefts that are interwoven with the warps of the fabric layer 101 and the warps of the fabric layer 102 for a binding pattern both in the warp direction and in the weft direction.

Figure 3:
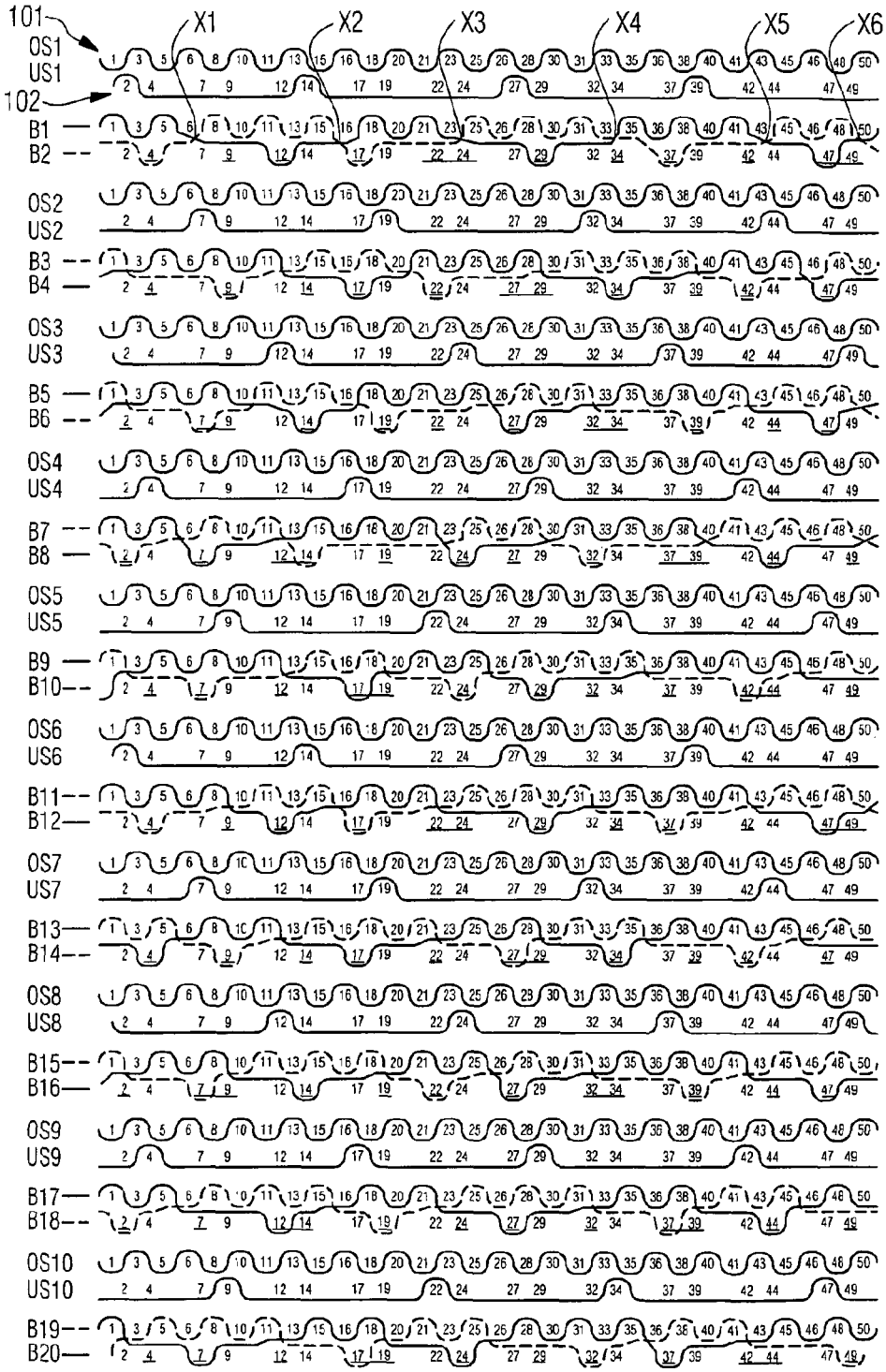
FIG. 3 is the weft course for a complete binding pattern of a first embodiment of a fabric belt at the warp ratio of 3:2 shown in FIG. 1.

The fabric belt 100 shown in FIG. 3 is a weft-bound fabric, e.g. the first fabric layer 101 is connected to the second fabric layer via binder wefts.

In all FIGS. 3-8 the warps OK of the first fabric layer 101 are first warps, e.g. warps, which are incorporated only into the first fabric layer. Furthermore, in all FIGS. 3-8 the warps UK of the second fabric layer 102 are second warps, e.g. warps, which are incorporated only into the second fabric layer.

Accordingly, warps 1, 3, 5, 6, 8, 10, 11, 13, 15, 16, 18, 20, 21, 23, 25, 26, 28, 30, 31, 33, 35, 36, 38, 40, 41, 43, 45, 46, 48, 50 correspond to the warps OK of the first fabric layer 101, while warps 2, 4, 7, 9, 12, 14, 17, 19, 22, 24, 27, 29, 32, 34, 37, 39, 42, 44, 47, 49 correspond to the warps UK of the second fabric layer 102.

The wefts present in the binding pattern are each arranged in pairs on top of each other, wherein one pair of wefts, which are incorporated exclusively into the upper fabric layer 101 or the lower fabric layer 102, alternates with a pair of wefts, which are interwoven into both fabric layers 101, 102, but which alternate between the same at crossing points in order to not to form a structure, but also to be effective in connecting both fabric layers 101 102 with each other. In the upper most line in FIG. 3 two wefts OS1 and US1 can be seen, of which weft OS1 is incorporated into the fabric layer 101 only, and binds off with the warps OK of the same in the manner of a plain weave. Weft US1 is incorporated into the fabric layer 102 only, in that the same has comparatively long floats on the outside, e.g. the running side, in order to provide a wear volume that is as great as possible.

A pair having wefts B1 and B2 then follows in the weft direction, which alternate between the first fabric layer 101 and the second fabric layer 102. In this manner both wefts B1, B2 factually form one single weft in the fabric layer in 101, which in turn binds off the warps OK present at that location in the manner of a plain weave. Another weft pair OS2, US2 then follows, of which the weft OS2 binds off identical to the first mentioned weft OS1, while weft US2 binds off via other warps UK of the fabric layer 102.

Said pattern is continued with alternating layers of the crossing points between the wefts of a respective pair of binder wefts and alternating layers of the binding points of the wefts US that are incorporated into the lower fabric layer 102 only across a complete binder pattern. It goes without saying that the binding pattern shown in FIG. 3 is only one example for a structure of a fabric belt 100 having a warp ratio of 3:2. In this regard different variations can be carried out in thread courses, in the binding structures, in the layers of the crossing points, etc. It further goes without saying that other warp ratios, such as 4:3, 5:3, 5:4, etc. may also be selected. All of the said warp ratios are characterized in that they are greater than 1, but not greater than 1.5, and are further not a whole number. One advantage of said warp ratios is that a very low fabric thickness can be achieved in this manner, while simultaneously ensuring a very good dewatering performance and a low water transport effect at a minimum hollow space volume.

The present weaving pattern of the second fabric layer 102 repeats in patterns that are each formed by five second wefts, such as US1-US5, and five second warps, such as 2,4,7,9,12, and 14. For this purpose each second weft US1-US5 crosses four successive second warps running on the outside of the second fabric layer 102 before the same crosses a second warp running between the first fabric layer 101 and the second fabric layer 102.

The weaving pattern of the fabric belt 100 is continued in total patterns, wherein the binder threads B1-B20 of each binder thread pair embodies more than two, e.g. in this case, six crossing points X within the total pattern. For example, the binder pair B1, B2 embodies the crossing points X1-X6 within the pattern of the fabric belt 100.

When viewed in the direction of the course of the wefts the warps of the first fabric layer 101 are arranged at a relative offset to the warps of the second fabric layer 102.

Furthermore, the ratio of the number of wefts of the first fabric layer 101, e.g. first wefts OS1-OS10 and binder weft pairs to the number of wefts of the second fabric layer 102, e.g. second wefts US1-US10, are greater than 1. This occurs, because each binder weft pair weaves a web path together with the first warps, which corresponds to the web path of a first weft, e.g. the binder wefts are an integral part of the first fabric layer 101, whereas the binder wefts are not an integral part of the second fabric layer 102.

The ratio of the number of wefts of the first fabric layer 101 to the number of wefts of the second fabric layer 102 is 2.0.

Furthermore, the binder weft B1-B20 of each pair interweaving first warps 1, 3, 5, 6, 8, 10, 11, 13, 15, 16, 18, 20, 21, 23, 25, 26, 28, 30, 31, 33, 35, 36, 38, 40, 41, 43, 45, 46, 48, 50 crosses at least two first warps between two successive crossing points X running on the outside of the first fabric layer 101. Specifically, the binder weft B1-B20 of a pair interweaving first warps 1, 3, 5, 6, 8, 10, 11, 13, 15, 16, 18, 20, 21, 23, 25, 26, 28, 30, 31, 33, 35, 36, 38, 40, 41, 43, 45, 46, 48, 50 crosses either two or three first warps between two successive crossing points X on the outside of the first fabric layer 101.

Furthermore the binder thread of each pair interweaving second warps 2, 4, 7, 9, 12, 14, 17, 19, 22, 24, 27, 29, 32, 34, 37, 39, 42, 44, 47, 49 crosses only one second warp between two successive crossing points X running on the outside of the second fabric layer 102.

For example, the binder thread B1 of the pair B1, B2 interweaving second warps crosses the first warp 12 between the two successive crossing points X1, X2 running on the outside of the second fabric layer 102.

In the present exemplary embodiment a first weft OS1-OS10 and a second weft US1-US10 is arranged between adjacent pairs of binder wefts B1-B20. For example, the first weft OS2 and the second weft US2 is arranged between the adjacent pairs B1, B2 and B3, B4.

Figure 2:
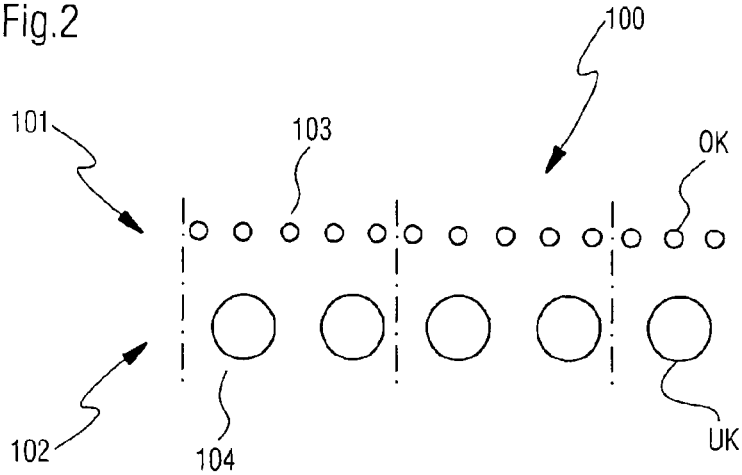
FIG. 2 is a view corresponding to that in FIG. 1 at a warp ratio of 5:2.

An alternative embodiment is shown in FIG. 2. Here it is obvious that the fabric belt 100 is again embodied using both fabric layers 101 and 102, wherein however the ratio of the warps OK of the first fabric layer 101 to the warps UK of the second fabric layer 102 corresponds at 5:2. This enables utilization of still thicker and thus more wear-resistant warps UK for the fabric layer 102 on the running side. This results in the fact that the mass of warps UK of the fabric layer 102 is also significantly greater in ratio to the mass of the warps OK of the first fabric layer 101, thus leading to a very smooth embodiment. Furthermore, it is of advantage at such a warp ratio that is greater than 1.5 to utilize wefts having a cross-sectional surface of greater than 0.1256 mm2. This particularly applies to the wefts primarily interwoven with the warps OK of the first fabric layer 101, which also ensure the stability required on the machine contact side.

It should finally be noted that the principles of the invention may also be applied to a fabric belt having more than two fabric layers. For example, a third fabric layer (not illustrated) may be present, which then provides the machine contact side such that the second fabric layer 102 shown in the figures is a center fabric layer. At this ratio to the third fabric layer the number of warps of the fabric layer 101 on the web material side may also be greater such that a ratio of greater than 1 is present between the fabric layer on the web material side and the fabric layer on the running side.

It should further be noted that the warps advantageously extend in the longitudinal web direction, while the wefts extend in a transverse web direction. In this manner it is possible to produce fabric belts at any desired dimension woven in adjustment to the longitudinal requirements using warps extending in the longitudinal web direction, and thus in the running direction of the belt.

Figure 4:
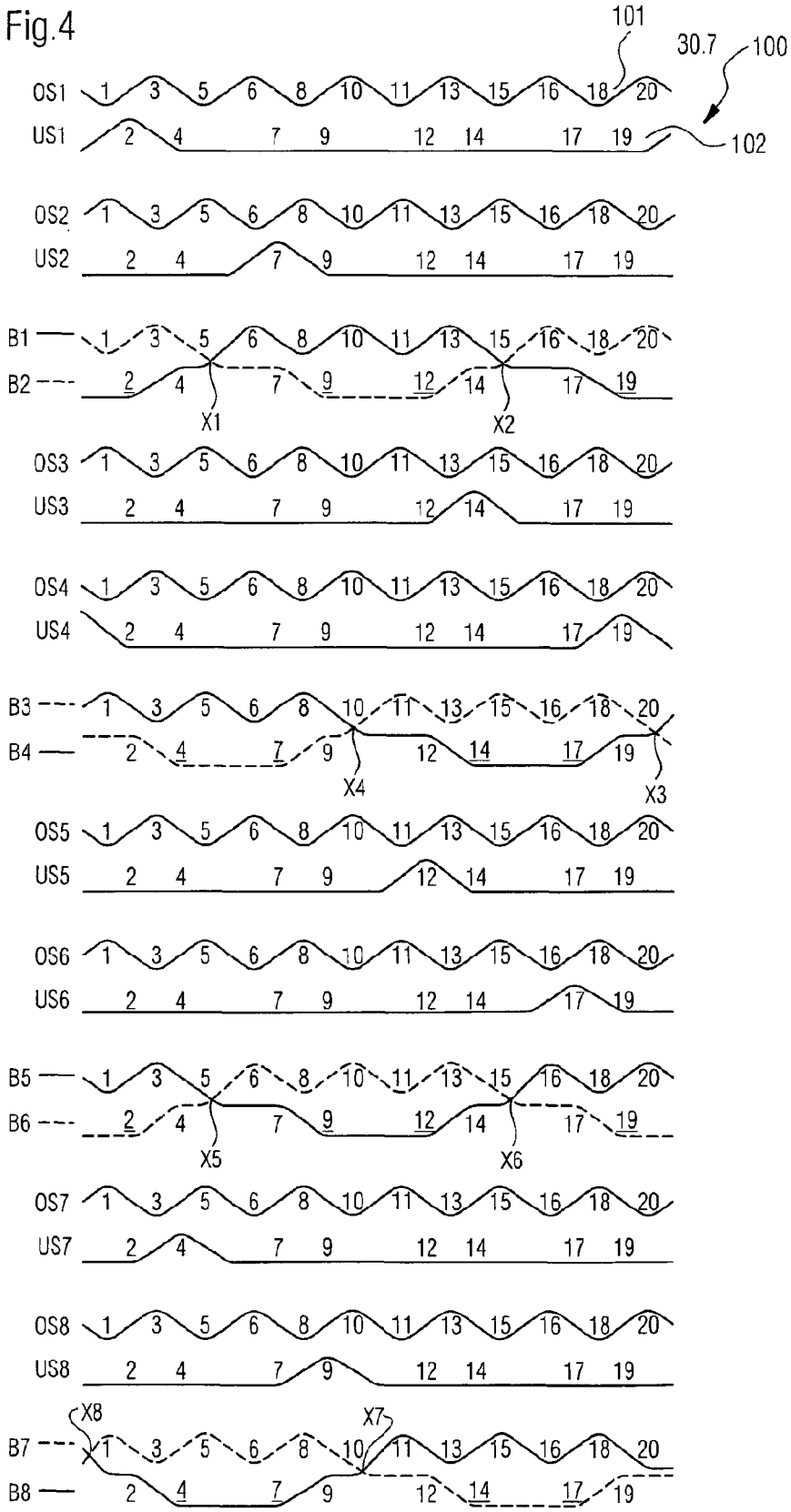
FIG. 4 is the weft courses for a complete binding pattern of a second embodiment of a fabric belt at the warp ratio of 3:2 shown in FIG. 1.

FIG. 4 illustrates the weft courses for a complete binding pattern of a second embodiment of the fabric belt 100 at the warp ratio of 3:2 as shown in FIG. 1.

The fabric belt 100 has a first fabric layer 101 and a second fabric layer 102. The first fabric layer 101 and the second fabric layer 102 are connected to each other via binder threads B1-B8.

In the present example the binder threads are binder wefts, and are arranged in pairs. For this purpose the binder threads B1-B8 of a pair, for example, B1, B2, or B3, B4, or B5, B6 alternate during the interweaving using threads of the first fabric layer 101 and the second fabric layer 102. Further, the binder threads of a pair cross the threads of the first fabric layer 101 during the alternating weaving for the purpose of interweaving with the threads of the second fabric layer 102, and vice versa, while forming crossing points X.

The first fabric layer 101 is formed by way of interweaving of first warps 1,3,5,8,10,11,13,15,16,18 and 20 with the first wefts OS1-OS8, and with the binder wefts B1-B8. In other words, part of the wefts of the first fabric layer forms first wefts OS1-OS8, another part of the wefts of the first fabric layer 101 forms the binder wefts B1-B8, and all warps of the first fabric layer 101 form first warps 1,3,5,8,10,11,13,15,16,18, and 20.

It should be noted at this point that the first warps and the first wefts contribute only to the interweaving of the first fabric layer 101, and are thus incorporated into the first fabric layer 101 only, e.g. the first warps and the first wefts do not contribute to the forming of the second fabric layer 102.

As can be seen in the illustration of FIG. 4, the binder threads of a pair alternate during the interweaving of the threads of the first fabric layer 101 such that together the same weave a mutual weaving path. For example, both binder threads B1, B2 of the pair weave a weaving path together with the first warps 1,3,5,8,10,11,13,15,16,18, and 20, e.g. both binder threads B1, B2 of the pair complement each other during the interweaving with the first warps 1,3,5,8,10,11,13,15,16,18, and 20.

The weaving pattern formed by the interweaving of the first warps 1,3,5,8,10,11,13,15,16,18, and 20 with the first wefts OS1-OS8 is continued by way of the alternating interweaving of the binder wefts B1-B8 with the first warps 1,3,5,8,10,11,13,15,16,18, and 20. This means that the binder threads in the first fabric layer 101 form a structure. As seen in the illustration of FIG. 4, the first fabric layer 101 forms a plain weave.

The second fabric layer 102 is formed by way of the interweaving of second warps 2,4,7,9,12,14,17, and 19 with second wefts US1-US8. In other words, all wefts of the second fabric layer 102 are second wefts US1-US8, and all warps of the second fabric layer 102 are second warps 2,4,7,9,12,14,17, and 19. For this purpose the first fabric layer 101 is connected to the second fabric layer 102 in that the binder wefts B1-B8 are interwoven with the first warps 1,3,5,8,10,11,13,15,16,18, and 20 and with the second warps 2,4,7,9,12,14,17, and 19.

It should be noted at this point that the second warps and the second wefts contribute only to the interweaving of the second fabric layer 102, e.g. the second warps and the second wefts do not contribute to the forming of the first fabric layer 101.

In the present example the weaving pattern of the second fabric layer 102 is continued in patterns formed by eight second wefts US1-US8 and eight second warps 2,4,7,9,12,14,17, and 19. For this purpose each second weft US1-US8 crosses seven successive second warps running on the outside of the second fabric layer 102, before the same crosses a second warp running between the first fabric layer 101 and the second fabric layer 102.

The weaving pattern of the fabric belt 100 is continued in total patterns, wherein the binder threads B1-B8 of each binder thread pair form two crossing points X within the total pattern. For example, the binder thread pair B1, B2 forms the crossing points X1 and X2 within the pattern of the fabric belt 100.

According to the invention the ratio of the number of warps of the first fabric layer 101, e.g. in this case the first warps 1,3,5,8,10,11,13,15,16,18, and 20, to the number of warps of the second fabric layer 102, e.g. in this case the second warps 2,4,7,9,12,14,17, and 19, is greater than 1. In this specific case the ratio is 1.5.

When viewed in the direction of the course of the wefts the warps of the first fabric layer 101, e.g. in this case the first warps 1,3,5,8,10,11,13,15,16,18, and 20, relative to the warps of the second fabric layer 102, e.g. in this case the second warps 2,4,7,9,12,14,17, and 19, are arranged at an offset.

Furthermore, the ratio of the number of wefts of the first fabric layer 101, e.g. the first wefts OS1-OS8, and the binder weft pairs to the number of wefts of the second fabric layer 102, e.g. the second wefts US1-US8, is greater than 1. This occurs, because each binder weft pair weaves a weaving path together with the first warps, which corresponds to the weaving path of a first weft, e.g. the binder wefts are an integral part of the first fabric layer 101, whereas the binder wefts are not an integral part of the second fabric layer 102.

Specifically, the ratio of the number of wefts of the first fabric layer 101 to the number of wefts of the second fabric layer 102 is 1.5.

Furthermore, the binder weft B1-B8 of each pair interweaving first warps 1,3,5,8,10,11,13,15,16,18, and 20 crosses at least two first warps between two successive crossing points X running on the outside of the first fabric layer 101. Specifically, the first binder weft B1-B8 of a pair interweaving the first warps 1,3,5,8,10,11,13,15,16,18, and 20 crosses three, e.g. an uneven number, first warps between two successive crossing points X running on the outside of the first fabric layer 101, wherein the center of the three first warps forms a crossing point of a pair of binder wefts positioned directly adjacent to the same.

For example, the binder weft B1 of the pair B1, B2 interweaving the first warps 1,3,5,8,10,11,13,15,16,18, and 20 crosses the three first warps 6, 8, and 10 between two successive crossing points X1, X2 running on the outside of the first fabric layer 101, wherein the center one of the three first warps, that is to say the first warp 10, forms a crossing point X4 and X7 of both pairs of binder wefts B3, B4, and B7, B8 that are positioned directly adjacent to the same.

As can be seen in FIG. 4 each binder thread of each binder thread pair crosses the same number of first warps between two successive crossing points running on the outside of the first fabric layer; specifically in this case three first warps.

Furthermore, the binder thread of each pair interweaving second warps 2,4,7,9,12,14,17, and 19 crosses two successive second warps 2,4,7,9,12,14,17, and 19 between two successive crossing points X running on the outside of the second fabric layer 102.

For example, the binder thread B2 of the pair B1, B2 interweaving second warps crosses both successive warps 9 and 12 between both successive crossing points X1, X2 running on the outside of the second fabric layer 102.

In the present exemplary embodiment two first wefts OS1-OS8 and two second wefts US1-US8 are arranged between adjacent pairs of binder wefts B1-B8. For example, the two first wefts OS3, OS4 and the two second wefts US3, US4 are arranged between the adjacent pairs B1, B2 and B3, B4.

Figure 5:
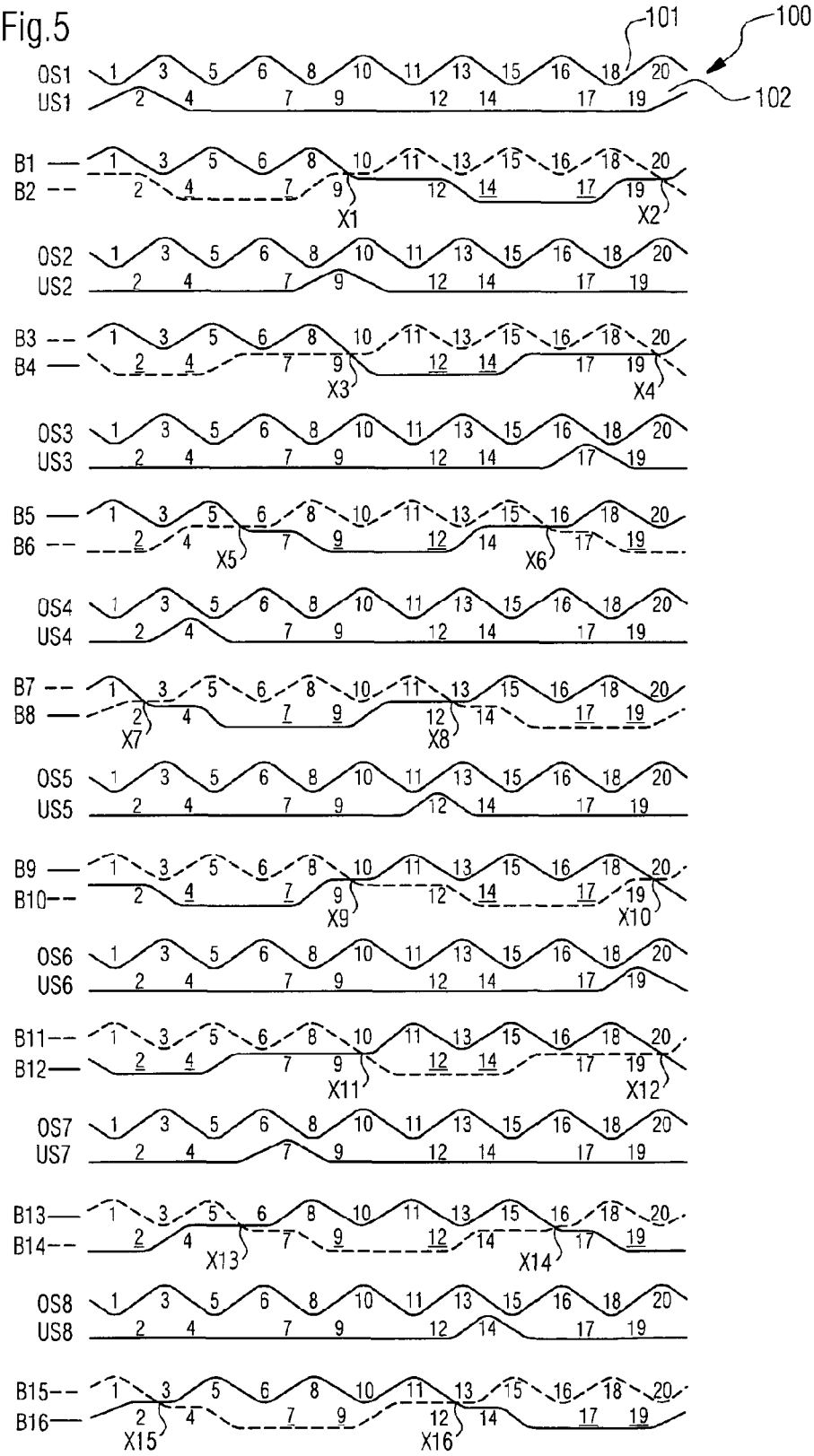
FIG. 5 is the weft courses for a complete pattern for a complete binding pattern of a third embodiment of a fabric belt at the warp ratio of 3:2 shown in FIG. 1.

FIG. 5 illustrates the weft courses for a complete binding pattern of a third embodiment of the fabric belt 100 at the warp ratio of 3:2 shown in FIG. 1.

The fabric belt 100 has a first fabric layer 101 and a second fabric layer 102. The first fabric layer 101 and the second fabric layer 102 are connected to each other via binder threads B1-B16.

In the present example the binder threads are binder wefts, and are arranged in pairs. For this purpose the binder threads B1-B16 of a pair, for example, B1, B2, or B3, B4, or B5, B6 alternate during the interweaving using threads of the first fabric layer 101 and the second fabric layer 102. Further, the binder threads of a pair cross the threads of the first fabric layer 101 during the alternating weaving for the purpose of interweaving with the threads of the second fabric layer 102, and vice versa, while forming crossing points X1-X16.

The first fabric layer 101 is formed by way of interweaving of first warps 1,3,5,8,10,11,13,15,16,18 and 20 with the first wefts OS1-OS16, and with the binder wefts B1-B8. In other words, part of the wefts of the first fabric layer forms first wefts OS1-OS8, another part of the wefts of the first fabric layer 101 forms the binder wefts B1-B16, and all warps of the first fabric layer 101 form first warps 1,3,5,8,10,11,13,15,16, 18, and 20.

It should be noted at this point that the first warps and the first wefts contribute only to the interweaving of the first fabric layer 101, e.g. the first warps and the first wefts do not contribute to the forming of the second fabric layer 102.

As can be seen in the illustration of FIG. 5, the binder threads of a pair alternate during the interweaving of the threads of the first fabric layer 101 such that together the same weave a mutual weaving path. For example, both binder threads B1, B2 of the pair weave a weaving path together with the first warps 1,3,5,8,10,11,13,15,16,18, and 20, e.g. both binder threads B1, B2 of the pair complement each other during the interweaving with the first warps 1,3,5,8,10,11,13, 15,16,18, and 20.

The weaving pattern formed by the interweaving of the first warps 1,3,5,8,10,11,13,15,16,18, and 20 with the first wefts OS1-OS16 is continued by way of the alternating interweaving of the binder wefts B1-B8 with the first warps 1,3,5,8,10, 11,13,15,16,18, and 20. This means that the binder threads in the first fabric layer 101 form a structure. As seen in the illustration of FIG. 5, the first fabric layer 101 forms a plain weave.

The second fabric layer 102 is formed by way of the interweaving of second warps 2,4,7,9,12,14,17, and 19 with second wefts US1-US8. In other words, all wefts of the second fabric layer 102 are second wefts US1-US8, and all warps of the second fabric layer 102 are second warps 2,4,7,9,12,14, 17, and 19. For this purpose the first fabric layer 101 is connected to the second fabric layer 102 in that the binder wefts B1-B16 are interwoven with the first warps 1,3,5,8,10, 11,13,15,16,18, and 20 and with the second warps 2,4,7,9,12, 14,17, and 19.

In the present example the weaving pattern of the second fabric layer 102 is continued in patterns formed by eight second wefts US1-US8 and eight second warps 2,4,7,9,12, 14,17, and 19. For this purpose each second weft US1-US8 crosses seven successive second warps running on the outside of the second fabric layer 102, before the same crosses a second warp running between the first fabric layer 101 and the second fabric layer 102.

The weaving pattern of the fabric belt 100 is continued in total patterns, wherein the binder threads B1-B8 of each binder thread pair form two crossing points X within the total pattern. For example, the binder thread pair B1, B2 forms the crossing points X1 and X2 within the pattern of the fabric belt 100.

According to the invention the ratio of the number of warps of the first fabric layer 101, e.g. in this case the first warps 1,3,5,8,10,11,13,15,16,18, and 20, to the number of warps of the second fabric layer 102, e.g. in this case the second warps 2,4,7,9,12,14,17, and 19, is greater than 1. In this specific case the ratio is 1.5.

When viewed in the direction of the course of the wefts, the warps of the first fabric layer 101, e.g. in this case the first warps 1,3,5,8,10,11,13,15,16,18, and 20, relative to the warps of the second fabric layer 102, e.g. in this case the second warps 2,4,7,9,12,14,17, and 19, are arranged at an offset.

Furthermore, the ratio of the number of wefts of the first fabric layer 101, e.g. the first wefts OS1-OS8, and the binder weft pairs to the number of wefts of the second fabric layer 102, e.g. the second wefts US1-US8, is greater than 1. This occurs, because each binder weft pair weaves a weaving path together with the first warps, which corresponds to the weaving path of a first weft, e.g. the binder wefts are an integral part of the first fabric layer 101, whereas the binder wefts are not an integral part of the second fabric layer 102.

Specifically, the ratio of the number of wefts of the first fabric layer 101 to the number of wefts of the second fabric layer 102 is 2.0.

Furthermore, the binder weft B1-B16 of each pair interweaving first warps 1,3,5,8,10,11,13,15,16,18, and 20 crosses at least two first warps between two successive crossing points X running on the outside of the first fabric layer 101. Specifically, the first binder weft B1-B8 of a pair interweaving the first warps 1,3,5,8,10,11,13,15,16,18, and 20 crosses three, e.g. an uneven number, first warps between two successive crossing points X running on the outside of the first fabric layer 101, wherein the center of the three first warps forms a crossing point of a pair of binder wefts positioned directly adjacent to the same.

For example, the binder weft B1 of the pair B1, B2 interweaving the first warps 1,3,5,8,10,11,13,15,16,18, and 20 crosses the three first warps 11, 15, and 18 between two successive crossing points X1, X2 running on the outside of the first fabric layer 101.

Furthermore, not all crossing points X1-X16 can be arranged on a parallel band of straight lines within the pattern of the fabric belt 100.

As can be seen in FIG. 5 each binder thread of each binder thread pair crosses the same number of first warps between two successive crossing points X running on the outside of the first fabric layer 101; specifically in this case three first warps.

Furthermore, the binder thread of each pair interweaving second warps 2,4,7,9,12,14,17, and 19 crosses two successive second warps 2,4,7,9,12,14,17, and 19 between two successive crossing points X running on the outside of the second fabric layer 102.

For example, the binder thread B2 of the pair B1, B2 interweaving second warps crosses both successive warps 4 and 7 between both successive crossing points X1, X2 running on the outside of the second fabric layer 102.

In the present exemplary embodiment a first weft OS1-OS8 and a second weft US1-US8 are arranged between two adjacent pairs of binder wefts B1-B16. For example, the first weft OS2 and the second weft US2 are arranged between the adjacent pairs B1, B2 and B3, B4.

Figure 6:
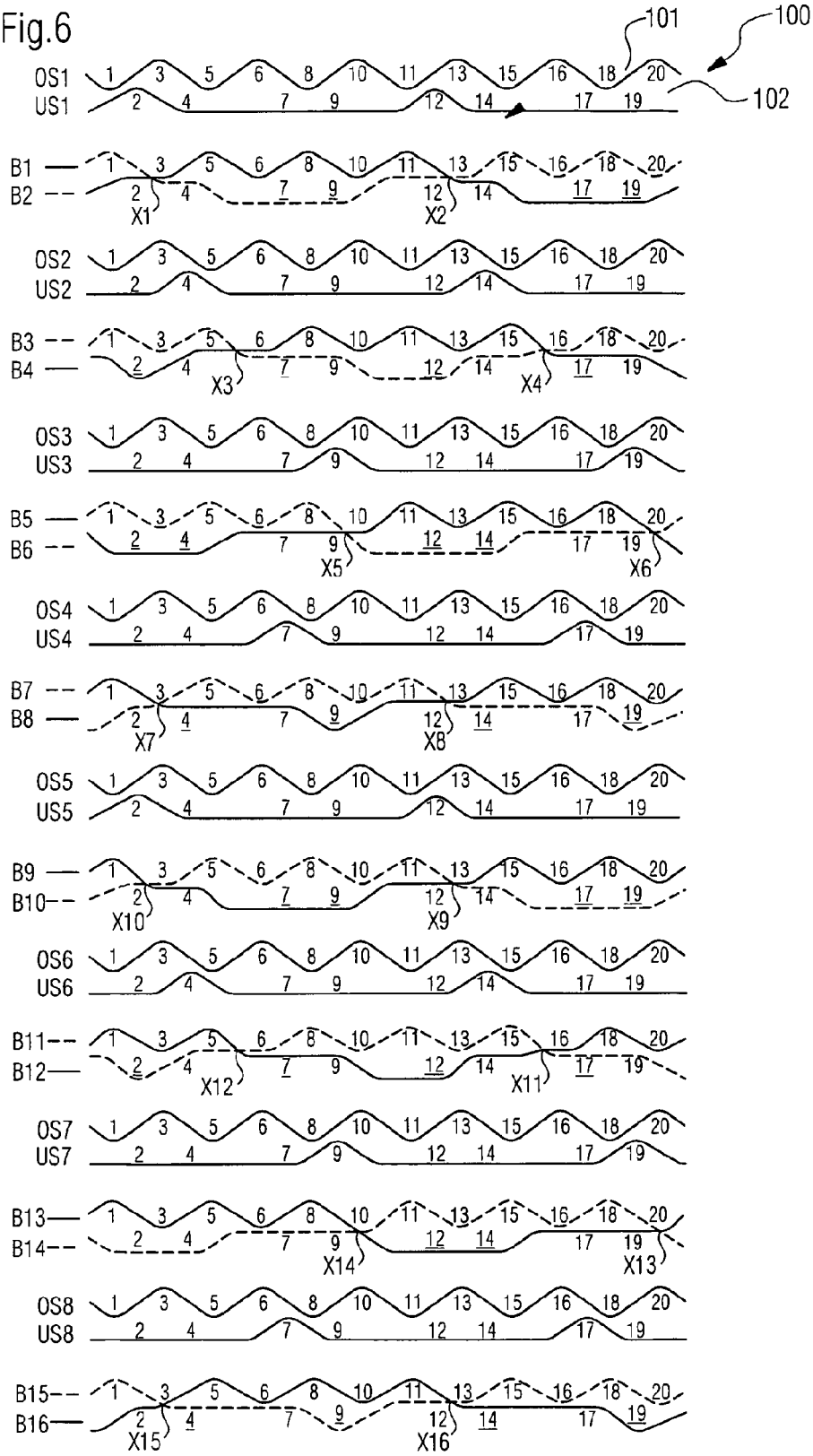
FIG. 6 is the weft courses for a complete pattern for a complete binding pattern of a fourth embodiment of a fabric belt at the warp ratio of 3:2 shown in FIG. 1.

FIG. 6 illustrates the weft courses for a complete binding pattern of a fourth embodiment of the fabric belt 100 at the warp ratio of 3:2 as shown in FIG. 1.

The fabric belt 100 has a first fabric layer 101 and a second fabric layer 102. The first fabric layer 101 and the second fabric layer 102 are connected to each other via binder threads B1-B16.

In the present example the binder threads are binder wefts, and are arranged in pairs. For this purpose the binder threads B1-B16 of a pair, for example, B1, B2, or B3, B4, or B5, B6 alternate during the interweaving using threads of the first fabric layer 101 and the second fabric layer 102. Further, the binder threads of a pair cross the threads of the first fabric layer 101 during the alternating weaving for the purpose of interweaving with the threads of the second fabric layer 102, and vice versa, while forming crossing points X1-X16.

The first fabric layer 101 is formed by way of interweaving of first warps 1,3,5,8,10,11,13,15,16,18 and 20 with the first wefts OS1-OS8, and with the binder wefts B1-B16. In other words, part of the wefts of the first fabric layer forms first wefts OS1-OS8, another part of the wefts of the first fabric layer 101 forms the binder wefts B1-B16, and all warps of the first fabric layer 101 form first warps 1,3,5,8,10,11,13,15,16,18, and 20.

It should be noted at this point that the first warps and the first wefts contribute only to the interweaving of the first fabric layer 101, e.g. the first warps and the first wefts do not contribute to the forming of the second fabric layer 102.

As can be seen in the illustration of FIG. 6, the binder threads of a pair alternate during the interweaving of the threads of the first fabric layer 101 such that together the same weave a mutual weaving path. For example, both binder threads B1, B2 of the pair weave a weaving path together with the first warps 1,3,5,8,10,11,13,15,16,18, and 20, e.g. both binder threads B1, B2 of the pair complement each other during the interweaving with the first warps 1,3,5,8,10,11,13,15,16,18, and 20.

The weaving pattern formed by the interweaving of the first warps 1,3,5,8,10,11,13,15,16,18, and 20 with the first wefts OS1-OS16 is continued by way of the alternating interweaving of the binder wefts B1-B8 with the first warps 1,3,5,8,10,11,13,15,16,18, and 20. This means that the binder threads in the first fabric layer 101 form a structure. As seen in the illustration of FIG. 6, the first fabric layer 101 forms a plain weave.

The second fabric layer 102 is formed by way of the interweaving of second warps 2,4,7,9,12,14,17, and 19 with second wefts US1-US8. In other words, all wefts of the second fabric layer 102 are second wefts US1-US8, and all warps of the second fabric layer 102 are second warps 2,4,7,9,12,14,17, and 19. For this purpose the first fabric layer 101 is connected to the second fabric layer 102 in that the binder wefts B1-B16 are interwoven with the first warps 1,3,5,8,10,11,13,15,16,18, and 20 and with the second warps 2,4,7,9,12,14,17, and 19.

In the present example the weaving pattern of the second fabric layer 102 is continued in patterns formed by four second wefts US1-US8 and four second warps 2,4,7,9,12,14,17, and 19. For this purpose each second weft US1-US8 crosses three successive second warps running on the outside of the second fabric layer 102, before the same crosses a second warp running between the first fabric layer 101 and the second fabric layer 102.

The weaving pattern of the fabric belt 100 is continued in total patterns, wherein the binder threads B1-B16 of each binder thread pair form two crossing points X within the total pattern. For example, the binder thread pair B1, B2 forms the crossing points X1 and X2 within the pattern of the fabric belt 100.

According to the invention the ratio of the number of warps of the first fabric layer 101, e.g. in this case the first warps 1,3,5,8,10,11,13,15,16,18, and 20, to the number of warps of the second fabric layer 102, e.g. in this case the second warps 2,4,7,9,12,14,17, and 19, is greater than 1. In this specific case the ratio is 1.5.

When viewed in the direction of the course of the wefts the warps of the first fabric layer 101, e.g. in this case the first warps 1,3,5,8,10,11,13,15,16,18, and 20, relative to the warps of the second fabric layer 102, e.g. in this case the second warps 2,4,7,9,12,14,17, and 19, are arranged at an offset.

Furthermore, the ratio of the number of wefts of the first fabric layer 101, e.g. the first wefts OS1-OS8, and the binder weft pairs to the number of wefts of the second fabric layer 102, e.g. the second wefts US1-US8, is greater than 1. This occurs, because each binder weft pair weaves a weaving path together with the first warps, which corresponds to the weaving path of a first weft, e.g. the binder wefts are an integral part of the first fabric layer 101, whereas the binder wefts are not an integral part of the second fabric layer 102.

Specifically, the ratio of the number of wefts of the first fabric layer 101 to the number of wefts of the second fabric layer 102 is 2.0.

Furthermore, the binder weft B1-B16 of each pair interweaving first warps 1,3,5,8,10,11,13,15,16,18, and 20 crosses at least two first warps between two successive crossing points X running on the outside of the first fabric layer 101. Specifically, the first binder weft B1-B16 of a pair interweaving the first warps 1,3,5,8,10,11,13,15,16,18, and 20 crosses three first warps between two successive crossing points X running on the outside of the first fabric layer 101.

For example, the binder weft B1 of the pair B1, B2 interweaving the first warps 1,3,5,8,10,11,13,15,16,18, and 20 crosses the three first warps 5, 8, and 11 between two successive crossing points X1, X2 running on the outside of the first fabric layer 101.

Furthermore, not all crossing points X1-X16 can be arranged on a parallel band of straight lines within the pattern of the fabric belt 100.

As can be seen in FIG. 6 each binder thread of each binder thread pair crosses the same number of first warps between two successive crossing points X running on the outside of the first fabric layer 101; specifically in this case three first warps.

For example, the first binder thread B1 of the pair B1, B2 crosses the three first warps 5, 8, 11 between the two successive crossing points X1, X2 running on the outside of the first fabric layer 101, and the second binder thread B2 of the pair B1, B2 crosses the three first warps 1, 15, 18 between two successive crossing points X1, X2 running on the outside of the first fabric layer 101.

Furthermore, the binder threads of each second binder thread pair cross two successive second warps 2,4,7,9,12,14, 17, and 19 between two successive crossing points X running on the outside of the second fabric layer 102 when the same interweave second warps 2,4,7,9,12,14,17, and 19, whereas the binder threads of each first binder thread pair cross only one second warp 2,4,7,9,12,14,17, and 19 between two successive crossing points X running on the outside of the second fabric layer 102 when the same interweave second warps 2,4,7,9,12,14,17, and 19. As can be seen in the illustration of FIG. 6, each first binder thread pair is arranged between two second binder thread pairs, as each second binder thread pair is arranged between two first binder thread pairs.

For example, the binder threads of the pair B1, B2 interweaving the second warps cross two successive warps 7 and 9 between two successive crossing points running on the outside of the second fabric layer 102, whereas the binder threads of the pair B3, B4 cross only one second warp between two successive crossing points running on the outside of the second fabric layer 102.

The above mentioned arrangement of first and second binder thread pairs is not limited to the exemplary embodiment of FIG. 6, but can be transferred to a plurality of embodiments of the fabric belts according to the invention.

In the present exemplary embodiment a first weft OS1-OS8 and a second weft US1-US8 are arranged between adjacent pairs of binder wefts B1-B16. For example, the first weft OS2 and the second weft US2 are arranged between the adjacent pairs B1, B2 and B3, B4.

Figure 7:
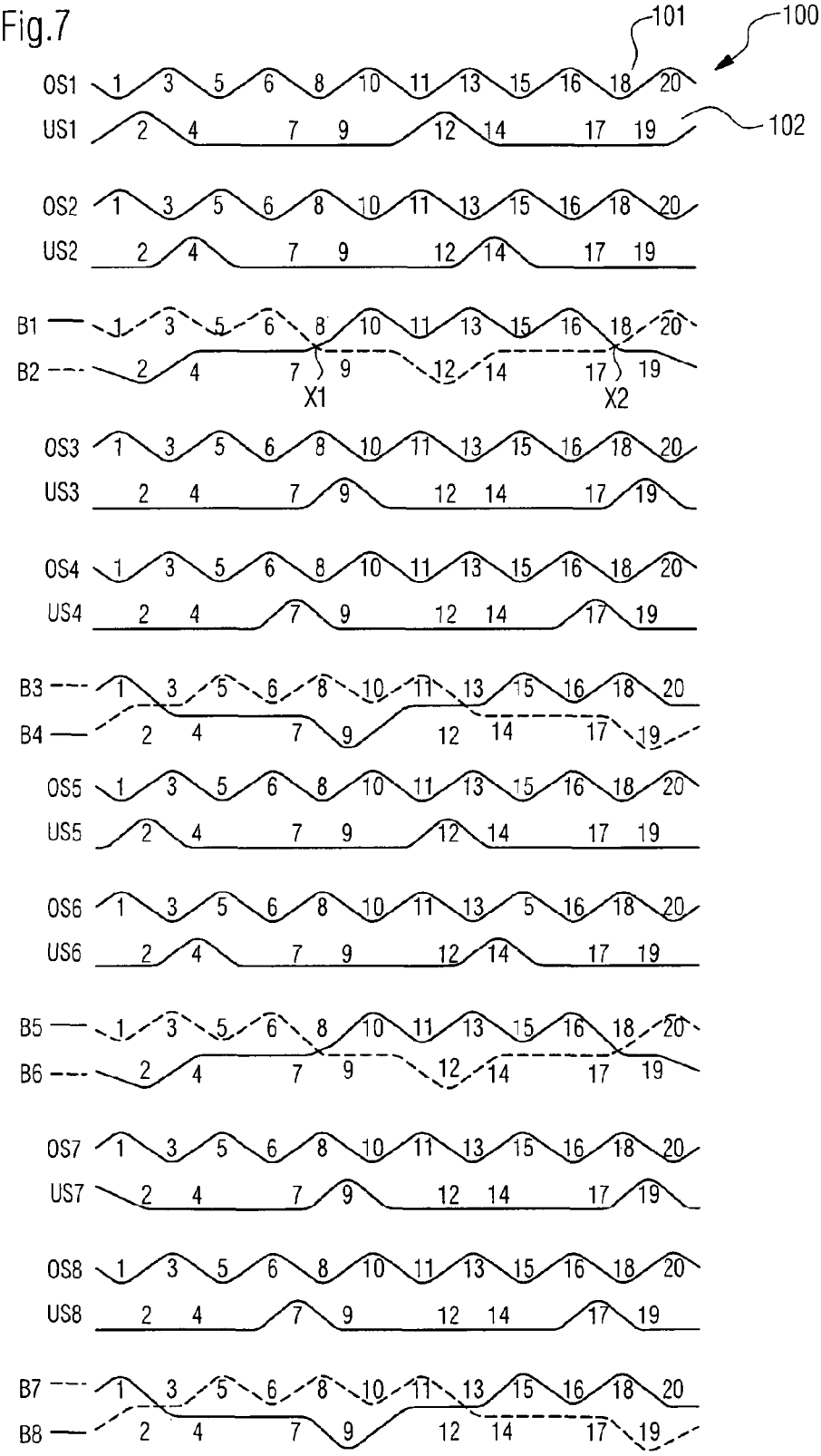
FIG. 7 is the weft courses for a complete pattern for a complete binding pattern of a fifth embodiment of a fabric belt at the warp ratio of 3:2 shown in FIG. 1.

FIG. 7 illustrates the weft courses for a complete binding pattern of a fifth embodiment of a fabric belt 100 at the warp ratio of 3:2 shown in FIG. 1.

The fabric belt 100 has a first fabric layer 101 and a second fabric layer 102. The first fabric layer 101 and the second fabric layer 102 are connected to each other via binder threads B1-B8.

The fabric belt illustrated in FIG. 7 differs from the fabric belt illustrated in FIG. 4 substantially in that the weaving pattern of the second fabric layer 102 is continued in patterns, which are formed by four second wefts US1-US8, and four second warps 2,4,7,9,12,14,17, and 19. For this purpose each second weft US1-US8 crosses three successive second warps running on the outside of the second fabric layer 102 before the same crosses a second warp running between the first fabric layer 101 and the second fabric layer 102.

The two fabric belts further differ in that in the fabric belt illustrated in FIG. 7 the binder thread of each pair interweaving second warps 2,4,7,9,12,14,17, and 19 crosses only one second warp 2,4,7,9,12,14,17, and 19 between two successive crossing points X running on the outside of the second fabric layer 102.

For example, the binder thread B2 of the pair B1, B2 interweaving second warps crosses the second warp 12 between the two successive crossing points X1, X2 running on the outside of the second fabric layer 102.

Figure 8:
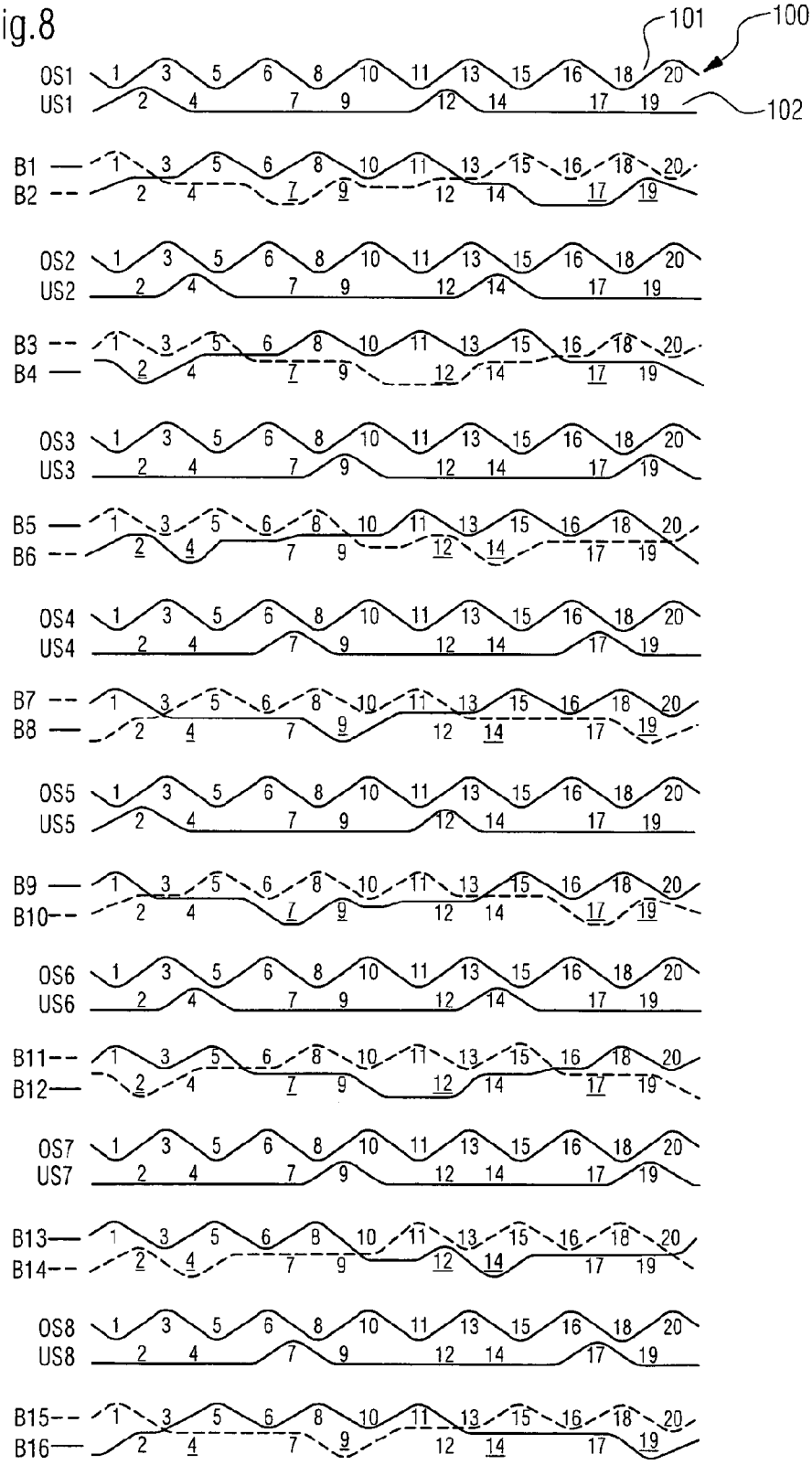
FIG. 8 is the weft courses for a complete pattern for a complete binding pattern of a sixth embodiment of a fabric belt at the warp ratio of 3:2 shown in FIG. 1.
Figure 9:
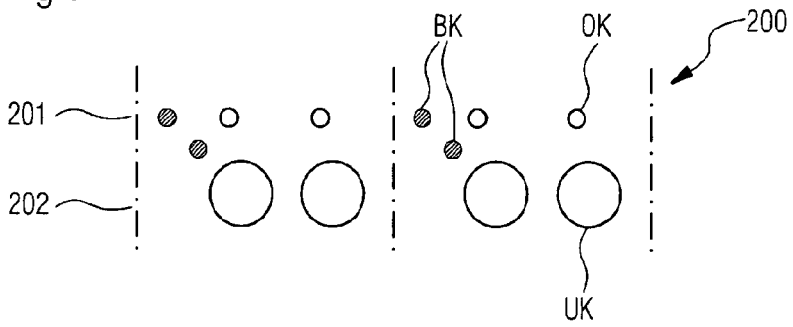
FIG. 9 is in a principal illustration a warp-bound fabric belt at a warp ratio of 3:2.

FIG. 8 illustrates the weft courses for a complete binding pattern of a sixth embodiment of a fabric belt 100 at the warp ratio 3:2 shown in FIG. 1.

The fabric belt 100 has a first fabric layer 101 and a second fabric layer 102. The first fabric layer 101 and the second fabric layer 102 are connected to each other via binder threads B1-B8.

The fabric belt illustrated in FIG. 8 differs from the fabric belt illustrated in FIG. 7 substantially in that a first weft OS1-OS8 and only one second weft US1-US8 are arranged between adjacent pairs of binder wefts B1-B16. For example, the first weft OS2 and the second weft US2 are arranged between the adjacent pairs B1, B2 and B3, B4. This results in the fact that the ratio of the number of wefts of the first fabric layer 101 to the number of wefts of the second fabric layer 102 is 2.

If a binder thread crosses one or two successive second warps 2,4,7,9,12,14,17, and 19 on the outside of the second fabric layer, a binding point including one or two second warps is formed. In the fabric belts shown in FIGS. 4, 5, 7, and 8 the distance between two binding points in all pairs of binder threads is either two successive second warps (see FIGS. 4 and 5), or three successive lower warps (see FIGS. 7 and 8).

In the fabric belt shown in FIG. 6 the distance between two binding points in the second binder thread pairs is two successive second warps, and in the first binder thread pairs three successive lower warps, wherein the first and second binder thread pairs are arranged in an alternating manner.

In all of the shown fabric belts the first warps may have a smaller cross-sectional dimension than the second warps. Further, the first wefts may have a smaller cross-sectional dimension than the second wefts. Furthermore, the first wefts may have a substantially equal cross-sectional dimension to the first warps. Additionally, the second wefts may have a larger cross-sectional dimension than the second warps.

In the fabric belts shown the density of the first warps in the first fabric layer may further be 25 per cm or more, preferably 30 per cm or more, particularly preferred 50 per cm or more, as may the density of the first wefts in the first fabric layer be 25 per cm or more, preferably 30 per cm or more, particularly preferred 40 per cm or more.

It is further purposeful if the warps extend in the longitudinal direction of the fabric belt, and the wefts extend in the transverse direction of the fabric belt.

Contrary to the fabric belts shown in FIGS. 1-8, FIG. 9 shows a fabric belt 200, wherein the first fabric layer 201 is connected to the second fabric layer 202 via pairs of binder warps BK.

For this purpose, the binder threads BK of a pair alternate during the interweaving of threads of the first and the second fabric layers and cross at the alternating from interweaving using threads of the first fabric layer 201 to the interweaving using threads of the second fabric layer 202, and vice versa, while forming crossing points.

For this purpose the binder warps BK of a pair alternate during the interweaving using the threads of the first fabric layer 201 such that together the same form a mutual weaving path during the weaving of the first fabric layer 201. Both binder warps BK of a pair therefore weave the first fabric layer 210 like a first warp.

The weaving pattern formed by way of the interweaving of the first warps OK with the first wefts is continued due to the alternating interweaving of the binder warps BK with the first wefts.

Accordingly, part of the warps of the first fabric layer 201 is warps OK, another part of the warps of the first fabric layer 201 is the binder warps BK arranged in pairs, and all wefts of the first fabric layer 201 are first wefts. Since the binder warps arranged in pairs form structures, the first fabric layer 201 is formed by way of the interweaving of the first wefts with the first warps OK and with the binder warps BK.

In contrast all warps of the second fabric layer 202 are warps UK, and all wefts of the second fabric layer are second wefts such that the second fabric layer 202 is formed only by way of the interweaving of the second wefts with the second warps UK. In this case the binder warps do not contribute to the weaving structure of the second fabric layer 202.

According to the invention the ratio of the number of warps OK, BK of the first fabric layer 201 to the number of warps UK of the second fabric layer is greater than 1, and is 1.5 in this particular case.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fabric belt for a machine for producing a web of fibrous material, comprising:

a first fabric layer including a web contact side and formed by interweaving a plurality of warps with a plurality of wefts; and a second fabric layer positioned below said first fabric layer and formed by interweaving a plurality of warps with a plurality of wefts, wherein said first fabric layer and said second fabric layer are connected to each other via a plurality of binder threads and said plurality of wefts of said first fabric layer and said plurality of wefts of said second fabric layer form a plurality of wefts of the fabric belt, at least a part of said plurality of wefts of the fabric belt being a plurality of binder wefts which form a connection between said first fabric layer and said second fabric layer and which form said plurality of binder threads, a first ratio of a number of said plurality of warps of said first fabric layer to a number of said plurality of warps of said second fabric layer being greater than 1, a second ratio of a number of said plurality of wefts of said first fabric layer to a number of said plurality of wefts of said second fabric layer being greater than 1, said first ratio not being a whole number, when viewed in a direction of a course of said plurality of wefts of at least one of said first and said second fabric layers said plurality of warps of said first fabric layer being arranged at an offset relative to said plurality of warps of said second fabric layer.

2. The fabric belt according to claim 1, wherein said first ratio is not greater than 1.5.

3. The fabric belt according to claim 1, wherein said second ratio is one of 1.5 and 2.

4. The fabric belt according to claim 1, wherein a part of said plurality of wefts of said first fabric layer is a plurality of first wefts and another part of said plurality of wefts of said first fabric layer is said plurality of binder wefts, all of said plurality of warps of said first fabric layer being a plurality of first warps, said first fabric layer being formed by an interweaving of said plurality of first warps with said plurality of first wefts and with said plurality of binder wefts.

5. The fabric belt according to claim 4, wherein a weaving pattern formed by said interweaving of said plurality of first warps with said plurality of first wefts is continued by an alternating interweaving of said plurality of binder wefts with said plurality of first warps.

6. The fabric belt according to claim 4, wherein said first fabric layer forms a plain weave.

7. The fabric belt according to claim 4, wherein all of said plurality of wefts of said second fabric layer are a plurality of second wefts and all of said plurality of warps of said second fabric layer are a plurality of second warps, said second fabric layer being formed by interweaving said plurality of second warps with said plurality of second wefts, said first fabric layer being connected to said second fabric layer in that said plurality of binder wefts are interwoven with said plurality of second warps.

8. The fabric belt according to claim 7, wherein a weaving pattern of said second fabric layer includes one of four and eight said second warps.

9. The fabric belt according to claim 8, wherein a weaving pattern of said second fabric layer is continued in a plurality of patterns, one said pattern being formed by way of four said second wefts and four said second warps, each said second weft crossing three successive said second warps running on an outside of said second fabric layer before crossing a respective said second warp running between said first and said second fabric layers.

10. The fabric belt according to claim 8, wherein a weaving pattern of said second fabric layer is continued in a plurality of patterns, one said pattern being formed by way of eight said second wefts and eight said second warps, each said second weft crossing seven successive said second warps running on an outside of said second fabric layer before crossing a respective said second warp running between said first and said second fabric layers.

11. The fabric belt according to claim 7, wherein said plurality of binder wefts include a plurality of binder weft pairs, said binder weft of each said binder weft pair interweaving said plurality of first warps crossing at least two said first warps between two successive crossing points running on an outside of said first fabric layer.

12. The fabric belt according to claim 7, wherein said plurality of binder wefts include a plurality of binder weft pairs, said binder weft of each said binder weft pair interweaving said plurality of first warps crossing an uneven number of said first warps between two successive crossing points running on an outside of said first fabric layer, a center one of said uneven numbered first warps forming a crossing point of a respective said binder weft pair positioned directly adjacent to said binder weft pair forming said center one of said uneven numbered first warps.

13. The fabric belt according to claim 7, wherein said plurality of binder threads are arranged in a plurality of pairs, said binder thread of each said binder thread pair interweaving said second warps crossing one of a respective said second warp and two successive said second warps between two successive crossing points running on an outside of said second fabric layer.

14. The fabric belt according to claim 7, wherein said plurality of binder wefts include a plurality of binder weft pairs, at least one of (a) one of one and two said first wefts and (b) one of one and two said second wefts being arranged between adjacent said binder weft pairs.

15. The fabric belt according to claim 7, wherein said first ratio of said number of said plurality of warps of said first fabric layer to said number of said plurality of warps of said second fabric layer is one of greater than and equal to 1.5, and a cross-sectional surface of said second wefts is in a range of 0.018 $mm^2$ to 0.284 $mm^2$.

16. The fabric belt according to claim 7, wherein said first ratio of said number of said plurality of warps of said first fabric layer to said number of said plurality of warps of said second fabric layer is one of greater than and equal to 1.5, and a cross-sectional surface of said second wefts is in a range of 0.023 mm2 to 0.197 $mm^2$.

17. The fabric belt according to claim 7, wherein said first ratio of said number of said plurality of warps of said first fabric layer to said number of said plurality of warps of said second fabric layer is one of greater than and equal to 1.5, and a cross-sectional surface of said second wefts is greater than 0.1256 $mm^2$.

18. The fabric belt according to claim 7, wherein said first ratio of said number of said plurality of warps of said first fabric layer to said number of said plurality of warps of said second fabric layer is one of greater than and equal to 1.5, and a cross-sectional surface of said first warps is one of smaller than and equal to 0.011 $mm^2$.

19. The fabric belt according to claim 7, wherein said first ratio of said number of said plurality of warps of said first fabric layer to said number of said plurality of warps of said second fabric layer is one of greater than and equal to 1.5, and a cross-sectional surface of said first warps is one of smaller than and equal to 0.008 $mm^2$.

20. The fabric belt according to claim 7, wherein said first warps have a smaller cross-sectional dimension than said second warps.

21. The fabric belt according to claim 7, wherein said first wefts have a smaller cross-sectional dimension than said second wefts.

22. The fabric belt according to claim 7, wherein said first wefts have a cross-sectional dimension that is substantially equal to that of said first warps.

23. The fabric belt according to claim 7, wherein said second wefts have a greater cross-sectional dimension than said second warps.

24. The fabric belt according to claim 7, wherein a density of said first warps in said first fabric layer is at least 25 per cm.

25. The fabric belt according to claim 7, wherein a density of said first warps in said first fabric layer is at least 30 per cm.

26. The fabric belt according to claim 7, wherein a density of said first warps in said first fabric layer is at least 40 per cm.

27. The fabric belt according to claim 7, wherein a density of said first wefts in said first fabric layer is at least 25 per cm.

28. The fabric belt according to claim 7, wherein a density of said first wefts in said first fabric layer is at least 30 per cm.

29. The fabric belt according to claim 7, wherein a density of said first wefts in said first fabric layer is at least 40 per cm.

30. The fabric belt according to claim 1, wherein said second fabric layer provides a machine contact side.

31. The fabric belt according to claim 1, wherein said plurality of warps of said first fabric layer and said plurality of warps of said second fabric layer form a plurality of warps of the fabric belt, said plurality of wefts of said first fabric layer and said plurality of wefts of said second fabric layer forming a plurality of wefts of the fabric belt, said plurality of warps of the fabric belt extending in a longitudinal direction of the fabric belt, said plurality of wefts of the fabric belt extending in a transverse direction of the fabric belt.

32. A fabric belt for a machine for producing a web of fibrous material, comprising:

a first fabric layer including a web contact side and formed by interweaving a plurality of warps with a plurality of wefts; and a second fabric layer positioned below said first fabric layer and formed by interweaving a plurality of warps with a plurality of wefts, a first ratio of a number of said plurality of warps of said first fabric layer to a number of said plurality of warps of said second fabric layer being one of greater than and equal to 1.5, a second ratio of a number of said plurality of wefts of said first fabric layer to a number of said plurality of wefts of said second fabric layer being greater than 1, said first fabric layer and said second fabric layer being connected to each other via a plurality of binder threads, said plurality of wefts of said first fabric layer and said plurality of wefts of said second fabric layer forming a plurality of wefts of the fabric belt, at least a part of said plurality of wefts of the fabric belt being a plurality of binder wefts which form a connection between said first fabric layer and said second fabric layer and which form said plurality of binder threads, a part of said plurality of wefts of said first fabric layer being a plurality of first wefts and another part of said plurality of wefts of said first fabric layer being said plurality of binder wefts, all of said plurality of warps of said first fabric layer being a plurality of first warps, said first fabric layer being formed by an interweaving of said plurality of first warps with said plurality of first wefts and with said plurality of binder wefts, all of said plurality of wefts of said second fabric layer being a plurality of second wefts and all of said plurality of warps of said second fabric layer being a plurality of second warps, said second fabric layer being formed by interweaving said plurality of second warps with said plurality of second wefts, said first fabric layer being connected to said second fabric layer in that said plurality of binder wefts are interwoven with said plurality of second warps, a cross-sectional surface of said first warps being one of smaller than and equal to 0.018 $mm^2$.

33. A fabric belt for a machine for producing a web of fibrous material, comprising:

a first fabric layer including a web contact side and formed by interweaving a plurality of warps with a plurality of wefts;

a second fabric layer positioned below said first fabric layer and formed by interweaving a plurality of warps with a plurality of wefts, a first ratio of a number of said plurality of warps of said first fabric layer to a number of said plurality of warps of said second fabric layer being greater than 1, a second ratio of a number of said plurality of wefts of said first fabric layer to a number of said plurality of wefts of said second fabric layer being greater than 1, said first ratio not being a whole number, when viewed in a direction of a course of said plurality of wefts of at least one of said first and said second fabric layers said plurality of warps of said first fabric layer being arranged at an offset relative to said plurality of warps of said second fabric layer; and a third fabric layer, which provides a machine contact side.

34. The fabric belt according to claim 33, wherein said third fabric layer includes a plurality of warps, said number of said plurality of warps of said first fabric layer being greater than a number of said plurality of warps of said third fabric layer.

* * * * *